US011758313B2

(12) United States Patent
Hung et al.

(10) Patent No.: US 11,758,313 B2
(45) Date of Patent: Sep. 12, 2023

(54) ELECTRONIC DEVICE

(71) Applicant: Chiun Mai Communication Systems, Inc., New Taipei (TW)

(72) Inventors: Ching-Ming Hung, New Taipei (TW); Sheng-Hsiung Tsai, New Taipei (TW); Pei-Shuang Huang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 17/587,098

(22) Filed: Jan. 28, 2022

(65) Prior Publication Data

US 2022/0256268 A1 Aug. 11, 2022

(30) Foreign Application Priority Data

Feb. 5, 2021 (CN) ..... 202110162187.5

(51) Int. Cl.
*H04R 1/08* (2006.01)

(52) U.S. Cl.
CPC ..... *H04R 1/086* (2013.01)

(58) Field of Classification Search
CPC ..... H04R 1/1086; H04R 2201/003; H04R 2499/11
See application file for complete search history.

(56) References Cited

FOREIGN PATENT DOCUMENTS

| | | | | |
|---|---|---|---|---|
| CN | 204929255 U | * | 12/2015 | |
| CN | 111065009 A | * | 4/2020 | ..... H04R 1/02 |
| CN | 111065009 A | | 4/2020 | |
| CN | 211429521 U | * | 9/2020 | |
| CN | 211429521 U | | 9/2020 | |

* cited by examiner

*Primary Examiner* — Sunita Joshi
(74) *Attorney, Agent, or Firm* — ScienBiziP, P.C.

(57) ABSTRACT

An electronic device includes a circuit board, a protective assembly, and a protective film. The protective assembly providing a cavity is arranged on one side of the circuit board. The protective assembly includes a first protective unit and a second protective unit. A third through hole communicating with the cavity is defined in the first protective unit. A supporting surface is defined on the second protective unit facing the third through hole. A projection of the third through hole is overlapped with a projection of the supporting surface along the first direction. The protective film is coupled to the protective assembly and arranged in the cavity to divide the cavity into a first cavity and a second cavity. The above-mentioned electronic device resists deformation of the protective film by setting the second protective unit between the circuit board and the protective film.

18 Claims, 4 Drawing Sheets

ELECTRONIC DEVICE

CROSS-REFERENCE TO RELATED APPLICATIONS

This application claims priority to Chinese Patent Application No. 202110162187.5 filed on Feb. 5, 2021, filed in China National Intellectual Property Administration, the contents of which are incorporated by reference herein.

FIELD

The subject matter herein generally relates to acoustic technology, and more particularly to an electronic device.

BACKGROUND

At present, more and more wearable electronic devices need to be provided with a high waterproof coefficient. The electronic devices include speaker or microphone. The waterproof coefficient of wearable electronic devices is mainly concerned with water blocking effect of holes of the speaker or the microphone. There are integrated structure with a higher waterproof coefficient that can be used for improving the waterproof coefficient of the speaker, while only a protective film can be used for improving the waterproof coefficient of the microphone.

When the protective film is used for improving the waterproof coefficient of the microphone, a baffle plate is usually arranged between the circuit board and the protective film to resist a deformation of the protective film. The baffle plate and the circuit board are provided with a plurality of through holes to ensure sound transmission. When the water pressure is exerted on the protective film, the protective film would be deformed towards the baffle plate. If the water pressure is too large, the protective film would be deformed into the through holes, even be ruptured due to a excessive deformation.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
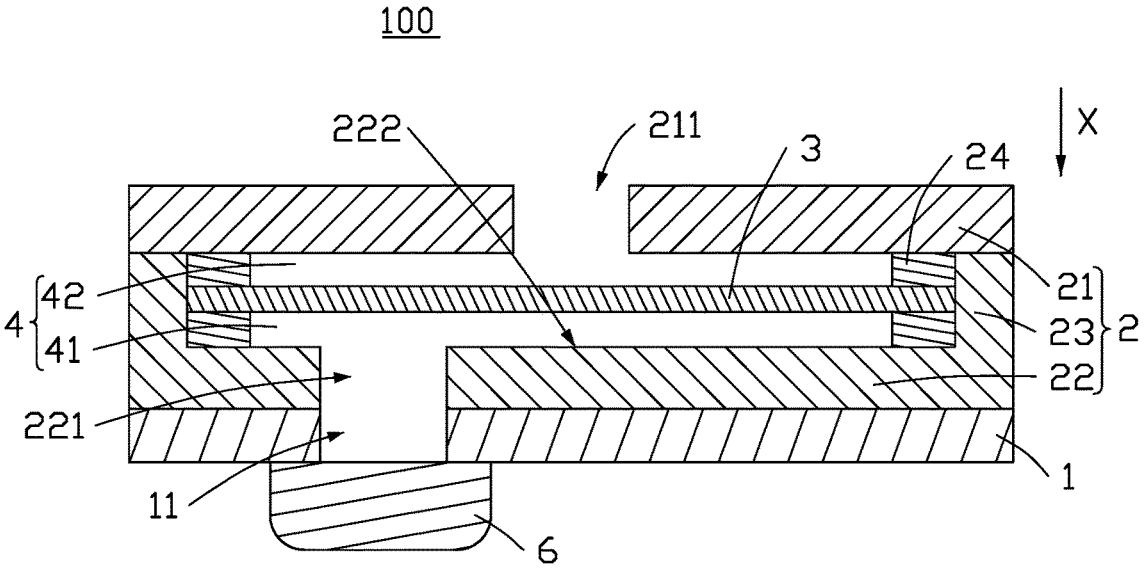
FIG. 1 is a cross-sectional view of an electronic device according to a first embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The present disclosure, including the accompanying drawings, is illustrated by way of examples and not by way of limitation. Several definitions that apply throughout this disclosure will now be presented. It should be noted that references to "an" or "one" embodiment in this disclosure are not necessarily to the same embodiment, and such references mean "at least one."

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series, and the like.

Without a given definition otherwise, all terms used have the same meaning as commonly understood by those skilled in the art. The terms used herein in the description of the present disclosure are for the purpose of describing specific embodiments only, and are not intended to limit the present disclosure.

As shown in FIG. 1, an electronic device 100 of a first embodiment includes a circuit board 1, a protective assembly 2, and a protective film 3. A first through hole 11 is defined in the circuit board 1. The protective assembly 2 is disposed on the circuit board 1 on one side of the circuit board 1. A cavity 4 is defined in the protective assembly 2, and the cavity 4 is in communication with the first through hole 11. The protective assembly 2 includes a first protective unit 21 and a second protective unit 22. The second protective unit 22 is arranged between the first protective unit 21 and the circuit board 1. A second through hole 221 is defined in the second protective unit 22, and the second through hole 221 is in communication with the first through hole 11. A third through hole 211 is defined in the first protective unit 21, and the third through hole 211 is in communication with the outside of the cavity 4. The second protective unit 22 includes a supporting surface 222 facing the third through hole 211. A projection of the third through hole 211 is overlapped with a projection of the supporting surface 222 along a first direction X. The first direction X is defined as a normal direction of the supporting surface 222. When air flows through the third through hole 211 from the outside of the capacitive cavity 4 along the first direction X, the air would get close to the supporting surface 222.

Figure 2:
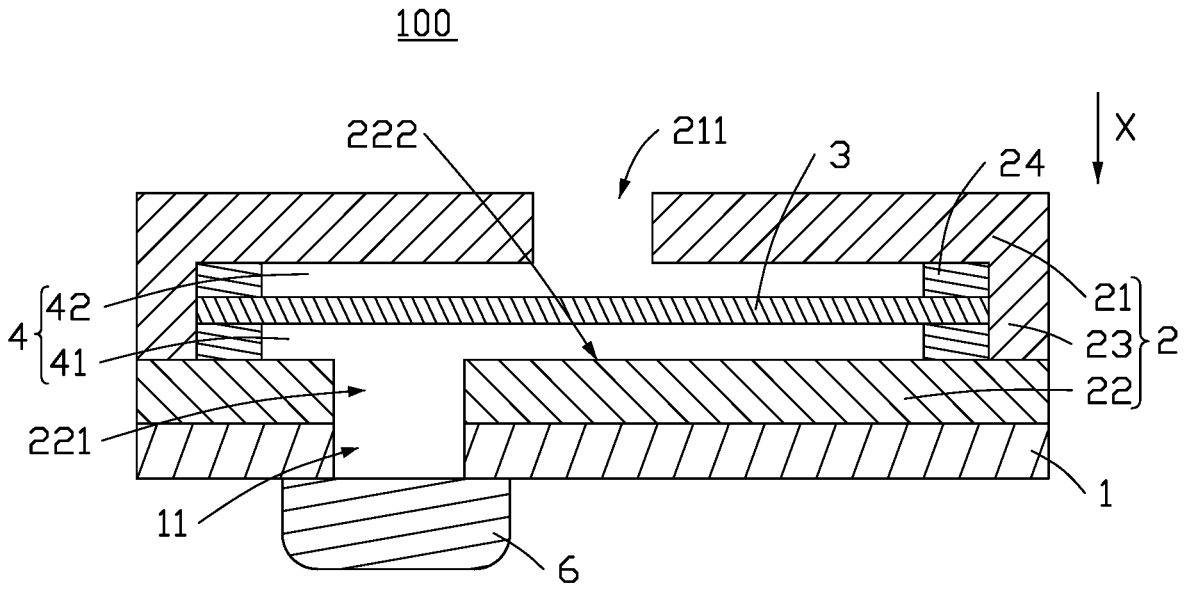
FIG. 2 is a cross-sectional view s of the electronic device according to a second embodiment of the present disclosure.

As shown in FIG. 2, the first protective unit 21 is connected with the second protective unit 22. The cavity 4 is formed by the first protective unit 21 and the second protective unit 22. The first protective unit 21 includes a bulge part 23. The second protective unit 22 is connected with the first protective unit 21 by the bulge part 23. Alternatively in an embodiment as shown in FIG. 1, a bulge part 23 is arranged on the second protective unit 22, but not on the first second protective unit 21. In the following description, the bulge part 23 is arranged on the second protective unit 22 as an example. In one embodiment is not shown in figures, the bulge part 23 can be independent of the first protective unit 21 and the second protective unit 22, the cavity 4 is shaped by after the first protective unit 21, the second protective unit 22, and the bulge part 23.

The protective film 3 is coupled to the protective assembly 2. The protective film 3 is arranged in the cavity 4 to divide the cavity 4 into a first cavity 41 and a second cavity 42. The first cavity 41 is in communication with the first through hole 11 through the second through hole 221. The second cavity 42 is in communication with the outside of the cavity 4 through the third through hole 211. Sound waves can be passed to the first through hole 11 through the third through hole 211, the second cavity 42, the protective film 3, the first cavity 41, and the second through hole 221 in turn.

The protective assembly 2 includes two fixtures 24. The fixtures 24 are arranged in the cavity 4. One of the fixtures 24 is connected with the first protective unit 21, another one of the fixtures 24 is connected with the second protective unit 22. The protective film 3 is clamped by the fixtures 24 along the first direction X, as long as the protective film 3 can be stably placed in the cavity 4. The protective film 3 may also be arranged in cavity 4 by other means, but not by the fixtures 24.

The electronic device 100 can further include a microphone or a speaker. In the following description, the electronic device 100 further includes a microphone 6 as an example.

The microphone 6 is arranged on one side of the circuit board 1 facing away from the protective film 3, and is disposed corresponding to the first through hole 11, so that the sound waves can be received by the microphone 6 from the first through hole 11. The protective film 3 is used for protecting the microphone 6, and preventing impurities from contaminating the microphone 6. The microphone 6 can be used in an environment with high water pressure to reduce a risk of damage to the microphone 6. The impurities include dust or water.

The sound waves can be passed to the microphone 6 through the third through hole 211, the second cavity 42, the protective film 3, the first cavity 41, the second through hole 221, and the first through hole 11. The protective film 3 can isolate the impurities entering the second through hole 221 from the third through hole 211, and prevent the impurities from contaminating the microphone 6.

Figure 3:
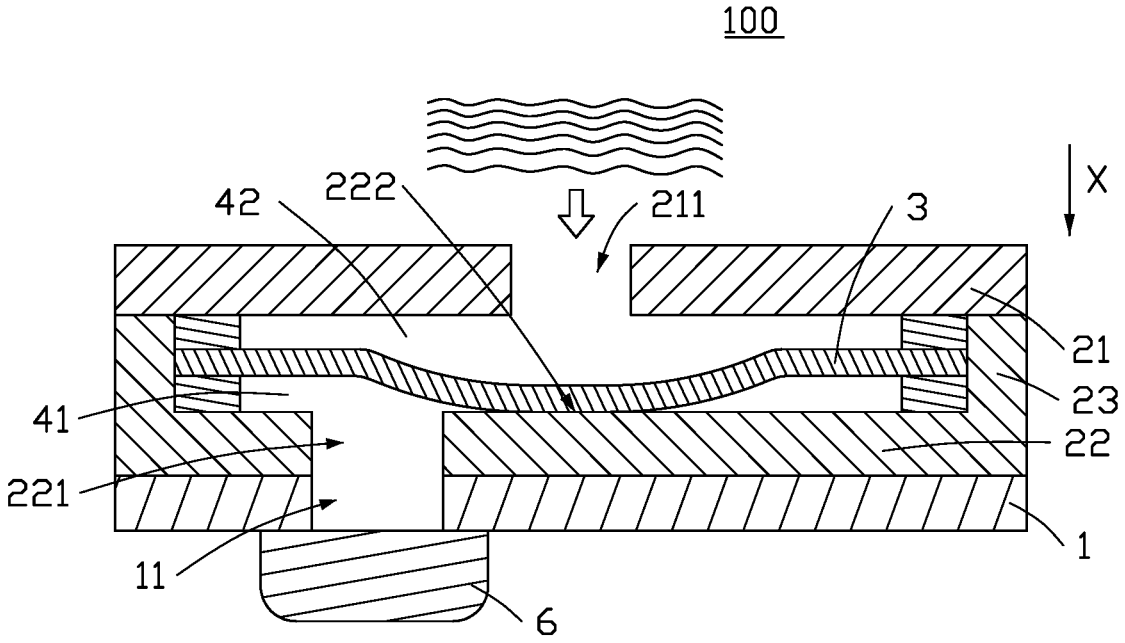
FIG. 3 is another cross-sectional view of the electronic device of the first embodiment, and showing a thin film being resiliently deformed.

As shown in FIG. 3, when the electronic device 100 is placed in water, the water can enter the second cavity 42 through the third through hole 211, and the water can be isolate from the microphone 6 by the protective film 3. When the pressure of water acting on the protective film 3 gets larger, the protective film 3 will be deformed towards the second protective unit 22. When a deformation of the protective film 3 is too large, the supporting surface 222 of the second protective unit 22 will be contacted with the protective film 3 to resist the deformation of the protective film 3. The supporting surface 222 can prevent the protective film 3 from being broken due to excessive deformation.

The larger the area of the protective film 3 is, the smaller a sound attenuation caused by the vibration of the protective film 3 is in a process of sound transmission. The area of the protective film 3 is larger than the area of the second through hole 221 to improve a reliability of sound transmission.

The protective film 3 can be deformed when subjected to pressure. The larger the area of the protective film 3, the smaller the pressure received in each unit area of the protective film 3, and the easier for the protective film 3 to return to a initial state. When the protective film 3 is in the initial state, the protective file is perpendicular to the first direction X. Increasing the area of the protective film 3 can effectively improve a service life and the reliability of the protective film 3.

The material of the protective film 3 can be polymer materials such as PTFE, PP, or PE. The polymer materials can improve the deformation performance of the protective film 3.

The first cavity 41 is located between the protective film 3 and the second protective unit 22. The second cavity 42 is located between the protective film 3 and the first protective unit 21. When the protective film 3 tends to be deformed by a vibration, the first cavity 41 and the second cavity 42 can provide space for the protective film 3. The sound waves can be passed between the first cavity 41 and the second cavity 42 by the vibration of the protective film 3. Sizes of the first cavity 41 and the second cavity 42 shall be subject to the requirements of actual application, which are not specifically limited in the present description. For example, if an irreversible deformation would occur since a deformation of the protective film 3 along the first direction X reaches 6 mm-8 mm, the size of the first cavity 41 along the first direction X can be set to 0.1-0.15 mm, the supporting surface 222 can resist the deformation of the protective film 3 along the first direction X.

The second protective unit 22 can be made of a metal material or a non-metallic hard material. The metal material includes iron. The electronic 100 includes an antenna. When the second protective unit 22 is made of the metal material, the transmission performance of the antenna may be affected by the second protective unit 22. When the second protective unit 22 is made of plastic material, only a protection level of 2 atm can be achieved due to a volatile characteristic of the plastic material. The second protective unit 22 should preferably be made of the non-metallic hard material, such as polyurethane, unsaturated polyester.

One or a plurality of the second through holes 221 are defined in the second protective unit 22.

As shown in FIG. 3, when only one second through hole 221 is defined in the second protective unit 22, a projection of the second through hole 221 overlapped with a projection of the first through hole 11 along the first direction X. The second through hole 221 and the third through hole 211 are staggered along the first direction X.

The circuit board 1 faces away from the protective film 3. The circuit board 1 is closely attached to one side of the second protective unit 22, which can minimize the attenuation during sound transmission from the second through hole 221 to the first through hole 11.

When the electronic device 100 is placed in water, the water can enter the second cavity 42 through the third through hole 211. A water pressure is exerted on the protective film 3. The protective film 3 is deformed towards the circuit board 1 by the water pressure. An apex of deformation of the protective film 3 is formed at a position corresponding to the third through hole 211 along the first direction X. The apex of deformation of the protective film 3 is contacted with the supporting surface 222 of the second protective unit 22. The supporting surface 222 can resist the deformation of the protective film 3, and prevent the protective film 3 from being broken due to excessive deformation.

The second through hole 221 and the third through hole 211 are staggered along the first direction X. When the protective film 3 is deformed towards the circuit board 1, the protective film 3 would attach to the supporting surface 222, but not get into the second hole 221. The supporting surface 222 can prevent the protective film 3 from being broken due to excessive deformation, and improve pressure-bearing capacity of the protective film 3.

Figure 4:
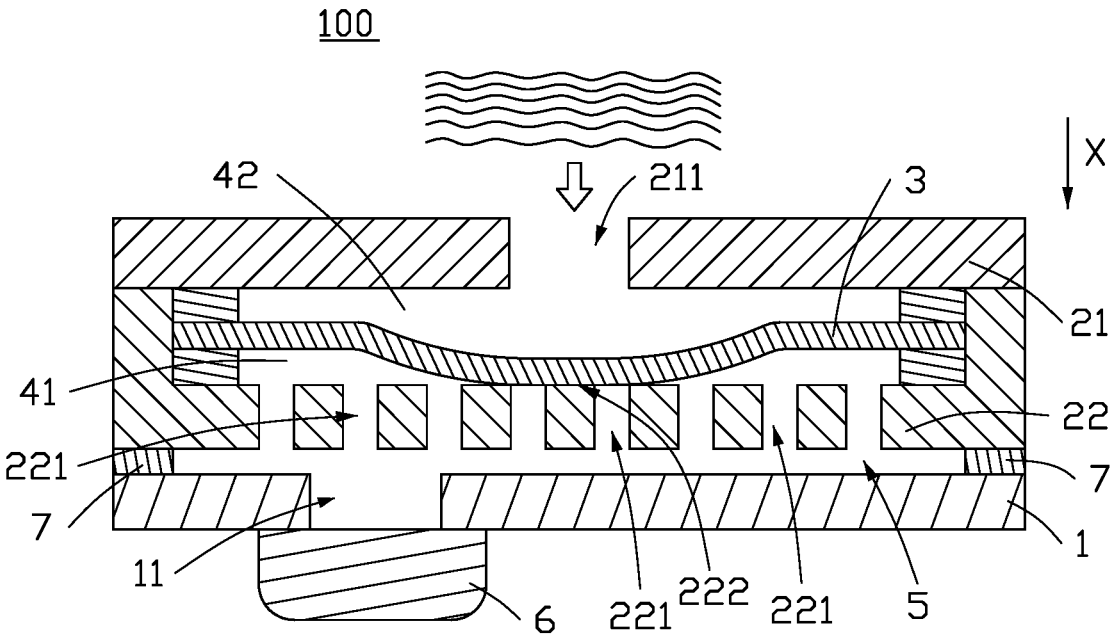
FIG. 4 is a cross-sectional view of the electronic device of a third embodiment, and showing a thin film being resiliently deformed.

As shown in FIG. 4, when a plurality of the second through holes 221 is defined in the second protective unit 22, an overlap area is defined as the aperture area of the second through hole 221 overlapping with the third through hole 211 along the first direction X. The overlap area is much smaller than the aperture area of the third through hole 211. When the protective film 3 is deformed towards the second protective unit 22, the protective film 3 can be supported on the supporting surface 222, and the protective film 3 will not be broken due to excessive deformation. A size of the overlap area shall be subject to the requirements of actual application. According to the material properties of the protective film 3, a diameter of the second through hole 221 can be set in the range of 0.03-0.2 mm.

The circuit board 1 is coupled to the second protective unit 22 by a gap along the first direction X. The gap 5 is formed between the circuit board 1 and the second protective unit 22. When the protective film 3 is deformed in towards the second protective unit 22 and attached to the supporting surface 222, an air flow in the second through hole 221 is enabled by the gap 5.

If the circuit board 1 and the second protective unit 22 are closely attached, when the protective film 3 is deformed towards the second protective unit 22 and attached to the supporting surface 222, air in the second through hole 221 will be compressed. A vibration of the protective film 3 will be affected by a compression of the air in the second through hole 221, and sound transmission by the protective film 3 will be affected.

The gap 5 between the circuit board 1 and the second protective unit 22 can reduce effect of the compression of the air in the second through hole on sound transmission, and improve the reliability of sound transmission by the protective film 3.

A connector 7 is arranged between the circuit board 1 and the second protective unit 22. The two ends of the connector 7 along the first direction X are respectively connected with the circuit board 1 and the second protective unit 22, and the gap 5 is formed by the circuit board 1, the second protective unit 22, and the connector 7.

When the electronic device 100 is placed in water, the water enters the second cavity 42 through the third through hole 211, and a water pressure is exerted on the protective film 3. The protective film 3 is deformed towards the circuit board 1 to touch the supporting surface 222. Since the overlap area is much smaller than the aperture area of the third through hole 211, the second protective unit 22 can not only resist the deformation of the protective film 3, but also prevent the protective film 3 from being broken due to excessive deformation, and improve a pressure-bearing capacity of the protective film 3.

In one embodiment, a position of the first through hole 11 is not limited to any fixed position, as long as the first through hole 11 can be in communication with the first cavity 41 through the gap 5 and the second through hole 221. By adjusting the position of the first pass hole 11, machining difficulty and cost of the electronic device 100 can be reduced.

In summary, the second protective unit 22 is arranged between the circuit board 1 and the protective film 3 to resist the deformation of the protective film 3, the second protective unit 22 can prevent the protective film 3 from being broken due to excessive deformation. One second through hole 221 is staggered with the third through hole 211 along the first direction X on the second guard 22, or a plurality of second through holes 221 with smaller diameters is arranged on the second guard 22. The second through hole 222 can improve the reliability of sound transmission. The electronic device 100 has a simple and reliable structure and saves production costs.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An electronic device comprising:

a circuit board comprising a first through hole;

a protective assembly, arranged on one side of the circuit board, comprising a first protective unit, a second protective unit, and a cavity communicating with the first through hole, wherein the first protective unit comprises a third through hole communicating with the cavity along a first direction, the second protective unit comprises a second through hole communicating with the first through hole, and comprises a supporting surface facing the third through hole, and a projection of the supporting surface is overlapped with a projection of the third through hole along the first direction; and a protective film fixedly coupled to the protective assembly, the protective film arranged in the cavity to divide the cavity into a first cavity and a second cavity, wherein the first cavity is in communication with the second through hole, and the second cavity is in communication with the third through hole;

the circuit board is attached to the second protective unit, a projection of the first through hole is overlapped with a projection of the second through hole along the first direction.

2. The electronic device of claim 1, wherein:

the second through hole is staggered with the third through hole along the first direction.

3. The electronic device of claim 1, wherein:

the first protective unit comprises a bulge part, the first protective unit is connected with the second protective unit by the bulge part; and the cavity is formed by the first protective unit and the second protective unit.

4. The electronic device of claim 1, wherein:

the second protective unit comprises a bulge part, the first protective unit is connected with the second protective unit by the bulge part; and the cavity is formed by the first protective unit and the second protective unit.

5. The electronic device of claim 1, wherein:

a material of the protective film comprises any one of PTFE, PP, and PE.

6. The electronic device of claim 1, further comprising a microphone, wherein:

the microphone is arranged on a side of the circuit board facing away from the protective film, and is disposed corresponding to the first through hole.

7. The electronic device of claim 1, wherein:

the protective assembly further comprising two fixtures, the fixtures are arranged in the cavity, one of the fixtures is connected with the first protective unit, another one of the fixtures is connected with the second protective unit, the protective film is clamped by the fixtures along the first direction.

8. The electronic device of claim 1, wherein:

an aperture area of the second through hole is less than or equal to an aperture area of the first through hole.

9. The electronic device of claim 1, wherein:

an area of the protective film is greater than an area of the second through hole.

10. The electronic device of claim 1, wherein:

a material of the second protective unit comprises polyurethane or unsaturated polyester.

11. An electronic device comprising:

a circuit board comprising a first through hole;

a protective assembly, arranged on one side of the circuit board, comprising a first protective unit, a second protective unit and a cavity communicating with the first through hole, wherein the first protective unit comprises a third through hole communicating with the cavity along a first direction, the second protective unit comprises a plurality of second through holes communicating with the first through hole, and comprises a supporting surface facing the third through hole, and a projection of the supporting surface is overlapped with a projection of the third through hole along the first direction; and a protective film fixedly coupled to the protective assembly, the protective film is arranged in the cavity to divide the cavity into a first cavity and a second cavity, the first cavity is in communication with the second through holes, the second cavity is in communication with the third through hole;

an aperture area of the second through hole overlapping with the third through hole in the first direction is less than an aperture area of the third through hole.

12. The electronic device of claim 11, wherein:

the circuit board is coupled to the second protective unit by a gap along the first direction, the first through hole is in communication with the second through holes through the gap between the circuit board and the second protective unit.

13. The electronic device of claim 12, further comprising a connector, wherein:

the connector is coupled to the circuit board and the second protective unit, and the gap is formed by the circuit board, the second protective unit, and the connector.

14. The electronic device of claim 11, wherein:

the first protective unit comprises a bulge part, the first protective unit is connected with the second protective unit by the bulge part; and the cavity is formed by the first protective unit and the second protective unit.

15. The electronic device of claim 11, wherein:

the second protective unit comprises a bulge part, the first protective unit is connected with the second protective unit by the bulge part; and the cavity is formed by the first protective unit and the second protective unit.

16. The electronic device of claim 11, wherein:

a material of the protective film comprises any one of PTFE, PP, and PE.

17. The electronic device of claim 11, further comprising a microphone, wherein:

the microphone is arranged on a side of the circuit board facing away from the protective film, and is disposed corresponding to the first through hole.

18. The electronic device of claim 11, wherein:

the protective assembly further comprising two fixtures, the fixtures are arranged in the cavity, one of the fixtures is connected with the first protective unit, another one of the fixtures is connected with the second protective unit, the protective film is clamped by the fixtures along the first direction.

* * * * *